US006550535B1

(12) United States Patent
Traylor

(10) Patent No.: US 6,550,535 B1
(45) Date of Patent: Apr. 22, 2003

(54) APPARATUS AND METHOD FOR THE DOWNHOLE GRAVITY SEPARATION OF WATER AND OIL USING A SINGLE SUBMERSIBLE PUMP AND AN INLINE SEPARATOR CONTAINING A CONTROL VALVE

(76) Inventor: Leland Bruce Traylor, 11510 Ranchitos Ave. NE., Albuquerque, NM (US) 87122

( * ) Notice: Subject to any disclaimer, the term of this patent is extended or adjusted under 35 U.S.C. 154(b) by 0 days.

(21) Appl. No.: 09/696,572

(22) Filed: Oct. 25, 2000

Related U.S. Application Data

(60) Provisional application No. 60/219,583, filed on Jul. 20, 2000.

(51) Int. Cl.[7] ..... E21B 43/38; E21B 43/40

(52) U.S. Cl. ..... 166/265; 166/105.5

(58) Field of Search ..... 166/265, 65.1, 166/105.5, 105.6, 66

(56) References Cited

U.S. PATENT DOCUMENTS

| | | | | |
|---|---|---|---|---|
| 3,915,225 A | | 10/1975 | Swink | |
| 4,766,957 A | | 8/1988 | McIntyre | |
| 4,934,458 A | | 6/1990 | Warburton | |
| 5,301,749 A | | 4/1994 | Fischer | |
| 5,335,732 A | | 8/1994 | McIntyre | |
| 5,443,120 A | * | 8/1995 | Howell | 166/265 |
| 5,697,448 A | | 12/1997 | Johnson | |
| 5,842,520 A | * | 12/1998 | Bolin | 166/369 |
| 5,857,519 A | * | 1/1999 | Bowlin et al. | 166/105.6 |
| 6,032,743 A | * | 3/2000 | Bowlin et al. | 166/369 |
| 6,092,599 A | | 7/2000 | Berry | |
| 6,131,660 A | * | 10/2000 | Stuebinger et al. | 166/265 |
| 6,336,504 B1 | * | 1/2002 | Alhanati et al. | 166/265 |

* cited by examiner

*Primary Examiner*—William Neuder
(74) *Attorney, Agent, or Firm*—Bauman, Dow, McIntosh & León, P.C.; Alberto A. León, Esq.

(57) ABSTRACT

The invention generally concerns an arrangement of a low volume submersible pump connected to a downhole gravity type oil-water separator. The low volume submersible pump is electrically powered using a flexible electrical cable that connects between the pump and electric power located at the ground surface. The low volume submersible pump is typically a positive displacement pump such as a piston pump or a hydraulically driven diaphragm pump but could be a centrifugal pump if the volumes produced are compatible with this method. The separator is located above or below the pump and is defined by an enclosed, pressure-tight volume created by a separate container or by two or three downhole packers. Located in the separator is a control valve that regulates the flow of oil and water from the separator to discharge tubes connected to the surface or to additional downhole apparatus.

17 Claims, 4 Drawing Sheets

APPARATUS AND METHOD FOR THE DOWNHOLE GRAVITY SEPARATION OF WATER AND OIL USING A SINGLE SUBMERSIBLE PUMP AND AN INLINE SEPARATOR CONTAINING A CONTROL VALVE

CROSS-REFERENCE TO RELATED APPLICATION

I hereby claim the benefit under Title 35, United States Code Section 119(e) of any United States Provisional Application(s) listed below:

Application No. 60/219,583

Filing Date: Jul. 20, 2000

BACKGROUND OF THE INVENTION

1. Technical Field of the Invention

Downhole oil water separators, Submersible pumps and submersible pump control systems.

2. Description of the Background Art

In the production of oil and gas from geologic formations, water is often produced along with the hydrocarbons. To make the hydrocarbons useful, they must be separated from the water, typically near the point of production. In the case of crude oil, this is typically accomplished by the use of a "heater treater" or "gunbarrel" separator located at the surface. These separators work on the principle of gravity separation; that is the oil is separated from the water by placing the mixture in a container, and allowing the lighter oil to float to the top of the container, the water to the bottom, and withdrawing the oil from the top, and the water from the bottom. Other methods are used to separate the oil from the water. Centrifugal separators, such as hydrocyclone separators, separate the oil from the water by causing the mixture to rotate and then withdraw the oil from the center of rotation, and the water from the outer diameter. All of these separators rely on the difference in densities between oil and water, and tend to separate via gravity or centrifugal force.

Over the past couple of decades, interest has increased in downhole separation of oil and water in oil wells because of the numerous advantages of this technique. The most important advantage is that the water produced can be immediately re-injected back into the formation without removing it from the well bore. This eliminates the need for above ground tanks, separators, and water disposal systems, reducing costs and the possibility of environmental damage. Downhole separation also is also simpler and cheaper than above ground separation. In addition, higher temperatures downhole often result in more complete separation.

The prior art suggests several combinations of downhole separator, pump and control system. In general, gravity type separators have been used exclusively in low flow rate wells, and dynamic type separators have been used with higher flow rate pumps. Gravity type separators are simpler but are limited in maximum flow rate because the mixed fluid must have sufficient dwell time in the separator to work. The dwell time needed depends on a number of factors such as the type of oil being produced, the size of the separator, the temperature, and oil droplet size going into the separator, but it is typically tens of minutes for oil wells. Because well bores are typically about 4 inches in diameter, and pipe units greater than 30 feet are difficult to handle using conventional workover rigs, the maximum downhole separator volume is about 0.5 barrels resulting in an average dwell time of 15 minutes at a production rate of 50 barrels per day. This would be about the largest flow rate achievable using a 30 foot long downhole separator. Gravity separators are limited in flow rate, but are much simpler than any other alternative.

Conversely, dynamic type separators such as hydrocyclone separators are seldom used in low flow rate wells because the stream of pumped fluid has insufficient kinetic energy to operate the separator. Dynamic separators are used at flow rates greater than 200 barrels of fluid per day. Dynamic separators can be used at lower flow rates, but additional kinetic energy must be added by accelerating the fluid using an impeller. This type of separator is more complex and expensive than gravity separation in low flow rate situations, and is normally used only in conjunction with submersible centrifugal pumps that offer a ready source of mechanical energy to operate the separator.

In practice, submersible centrifugal pumps are used at higher flow rates because they are inefficient and expensive to use at lower flow rates. Mechanically actuated pumps such as sucker rod pumps or progressing cavity pumps most often used at the lower flow rates. As a result, the use of gravity separation and mechanically actuated pumps is a compatible combination. U.S. Pat. No. 3,915,229 is an example of such an approach. At higher flow rates, gravity separation is impractical because of limitations of the volume of the separator downhole, therefore dynamic separators are typically used in conjunction with submersible centrifugal pumps.

The use of mechanically actuated pumps with gravity separators poses several significant problems. First of all, three connections to the surface are required. The first is the conduit for oil, the second a conduit for water, and the third is the mechanical power transmission mechanism. Mechanical power transmission mechanisms are typically bulky, and produce a reaction force that must be borne by some means. For example, a sucker rod pump uses a 1 inch diameter rod reacted by heavy walled tubing that is 2.5 inches in diameter that transports one fluid (typically oil) to the surface and power from the surface to the pump. This leaves a very small space, less than 0.75 inches to conduct the other fluid (typically water) to the surface using an additional pipe in parallel with the tubing/rod string. Typically there is very little room for this additional conduit let alone a sufficiently sized separator volume. A more serious problem arises as a result of the fact that the pump is typically located below the separator if one pump is used. This requires that the power transmission mechanism be routed through or around the separator to activate the pump. This further reduces the volume of the separator and because these mechanisms are large, this creates a serious design problem for the separator resulting in complexity, expense, and loss of efficiency.

U.S. Pat. No. 3,915,225, addresses this problem by locating the separator below the mechanical pump, eliminating the need for the power transmission mechanism to pass through the separator. Under this method the unseparated fluid enters the separator from the well bore to replace the oil is withdrawn by the pump, and the water exits the well bore by gravity into a disposal zone below the separator. The pump is activated when the oil level in the separator reaches a predetermined level. This approach will work only if the water will flow away from the well bore without being pumped into the formation under pressure. This is almost never the case in most oil wells. Both the oil and the water need to be pressurized for reliable operation.

U.S. Pat. No. 4,766,957 improves upon the methods of the '225 patent by providing two pumps, one to pump the separated oil to the surface, and another (if required) to pressurize the water being injected back into the disposal zone. The use of two pumps, while feasible, creates additional complexity and expense over any system that uses a single pump.

U.S. Pat. No. 5,697,448 further improves upon the methods of the '225 and the '957 patents by providing two mechanically actuated rod pumps powered by a single rod, where the oil is pumped on the up stroke and water is pumped on the downstroke. This method has two drawbacks that are addressed by the present invention. First, the method of the '448 patent is only useful with a sucker rod pump, and not useful with a submersible pump, leading to the problems already discussed. Second, because the oil is pumped on the up stroke and water is pumped on the downstroke the ratio of water to oil must be known and incorporated into the structure of the pump. If the ratio of water to oil is not known, changes with time, or is calculated incorrectly, either oil will be injected into the water zone or water will be produced with the oil. The use of two pumps, although powered by a single power source, further complicates the system and adds an additional expense.

A much more practical approach would be to use a single electrically powered submersible pump in conjunction with a downhole gravity separator. This would allow the power to be transmitted on a relatively small, flexible electrical cable and provide for automatic adjustment of the relative amounts of oil and water produced.

SUMMARY OF THE INVENTION

I disclose an arrangement which results from connecting a low volume submersible pump to a downhole gravity type oil water separator. The low volume submersible pump is powered electrically using a flexible electrical cable that connects between the pump and the surface. The low volume submersible pump is typically a positive displacement pump such as a piston pump or a hydraulically operated diaphragm pump but could be a centrifugal pump if volumes produced are compatible with this method. The separator may be located above or below the pump and is defined by an enclosed, pressure tight volume created by a separate pressure tight container or by two or more downhole packers. Located in the separator is a control valve that regulates the flow of oil and water from the separator to discharge tubes connected to the surface or to additional downhole apparatus.

U.S. Pat. No. 6,017,198 describes an ideal pump for this application. The '198 patent describes a submersible, electrically powered hydraulic diaphragm pump powered by an integrated electrical motor. This pump produces up to 200 barrels of fluid and is capable of variable flow by either varying the motor speed or by cycling the electrical motor on and off. Most importantly, this pump is capable of producing low flow rates to high pressures while maintaining system efficiency. Other positive displacement pumps such as submersible piston pumps and submersible progressing cavity pumps can also be used. Submersible centrifugal pumps typically produce too high of flow rate, but could be used if the separator volume is large, and the submersible pump output volume is low.

The downhole separator is located either directly above or below the submersible pump and is connected to the pump by a single pipe. The submersible pump is located near the production perforations and fluid from the surrounding geologic formation, which contains a mixture of oil and water, flows to the inlet of the pump and is injected under pressure into the separator. The separator is located below the pump when the water is re-injected into the formation below the pump. The separator can be located as far above/below the submersible pump as needed. One may select to locate the separator in the vicinity of the disposal zone so that the separator volume is located adjacent to the disposal zone and can be easily connected to the separator. The separator consists of a volume of fluid, isolated in a pressure tight container, located inside the well casing. The separator can be a separate container such as a cylinder with closed ends made of a material capable of withstanding the discharge pressure of the pump or it can be created by the well casing and two downhole packers, located at the bottom and top of the separator. Downhole packers are commonly used to isolate portions of the well casing to separate vertical zones. Model ETI-1x manufactured by Elder Tools is an example of a packer that can be used in this invention. Packers can be set (sealed to the casing) using a variety of methods such as turning to set, downward or upward pressure or fluid pressure to seal the packer to the casing. The lower packer of this invention can be of a special design to bridge across the perforations at the disposal zone, to create two sealed volumes in the casing. In this case, the upper volume, between the upper seal on the lower packer and the upper packer defines the separator, and the volume between the upper seal on the lower packer and the lower seal on the lower packer defines the water injection zone.

The separator should be of a suitable size for the volume produced by the well. The ideal separator dwell time can be calculated by dividing the volume of the separator by the flow rate of the pump. The dwell time should be 10 minutes or greater to achieve effective separation. The length of a downhole separator created by a separate container is limited by the ability of pulling rigs to install pipes into wells. This limits the maximum size to about 30 feet. Larger separators can be achieved by screwing sections together, but this creates more complexity. Separators defined by downhole packers have no such limitations, and are capable of larger capacities and higher flow rates with little increase in weight or complexity.

If the separator volume is above the pump, pressure tight electrical penetrators are typically used to pass electrical power from the cable to the volume above the separator into the separator, and from inside the separator to the volume directly below the separator, that contains the submersible pump. These penetrators are well known in the field, and are readily available. The electrical cable inside the separator is relatively small and flexible, allowing it to pass through without interfering with the operation of the separator.

The discharge of the submersible pump should enter the separator approximately in the vertical center of the separator volume or at a level sufficiently above the water discharge point to avoid interference. This requires a discharge tube to conduct fluid from the submersible pump to the middle of the separator or a suitable distance above or below the water or oil discharge points.

One or more discharge control valves are used. If a single valve is used for both oil and water, the discharge control valve is located between the top and bottom of the separator and is connected by pipes to a point near the top and bottom of the separator so that both the oil and the water discharge through the valve. In many situations, one of the two fluid streams, typically the water stream, discharges at a lower pressure than the other. In this case, it is only necessary to control the flow of the lower pressure stream with a control valve. This is almost always the case when a downhole zone is used for fluid disposal, and can result in a significantly simplified separator because a valve is not needed for the oil stream. In this simplified case, a single valve, located near the bottom of the separator, is used to regulate the flow of water out of the separator, and the oil is discharged near the top of the separator, into a discharge pipe that leads to the surface.

Alternatively, as many as three valves can be used, one for oil, located at the top of the separator, between the separator volume and the oil discharge tube; one for water, located near the bottom of the separator, or connected by pipes to a point near the bottom of the separator; and one for gas, located near the top of the separator. A typical discharge control valve or valves contains an oil section, that has an input connected to a tube that terminates near the top of the separator, and a water section that has an input connected to a tube that terminates near the bottom of the separator. The oil section has an output tube connected to a tube that exits the top of the separator and is connected to the surface. Likewise, the water section has an output tube that exits the top or bottom of the separator and is connected to the surface or to a downhole water disposal system that may be located above or below the pump. When the water is disposed downhole, the output tube is connected to an area in the well casing separated from the production zone by at least one disposal packer, and in that area, the casing is perforated to allow the water to flow from the separator, through the water output tube, through the disposal perforations, and into an area outside the casing. The packer or packers used to separate the production zone (near the pump inlet) from the disposal zone may be the same packers used create the separator, or may be an additional packer or packers. In the situation where one of the two fluid streams, typically the water stream, is discharging at a lower pressure than the other stream, a simpler valve, consisting of only a water or an oil section is used. A gas valve may also be used, located near the top of the separator, to discharge any gas that may accumulate inside the separator. Gas may also be discharged through the oil output valve.

Many combinations of valve location and combination of functions with appropriate plumbing are clearly possible. This valve or valves adjusts the relative amounts of oil and water discharged into the oil and water output tubes based on the position of a float that floats on top of the water but sinks in oil. The float is set so that it opens the water section valve more and starts to close the oil section valve when the float moves lower then the vertical center of the separator, and does the reverse when the float rises above the vertical center of the separator. In this way, the valve tends to create a condition where the interface between the oil and the water remains at the center of the separator. The float is connected mechanically or magnetically to the valve or valves using a rigid or flexible linkage. A simple bead chain is an example of a mechanical linkage that can be used. Other more complex techniques that involve electrically actuated valves and sensors can also be used, but the mechanical technique is preferred.

If a gas valve is used, it has a float that rises in oil and water, but sinks in gas. When the gas exceeds a preset level, the valve opens, allowing gas to be discharged from the separator.

The output tubes that are connected to the oil section and the water section of the discharge control valve are connected to the surface or other downhole apparatus. This connection can be made in a number of ways depending on the exact installation. The most efficient method is to use coiled tubing, which is a type of small diameter, flexible steel tubing commonly used in oil and gas operations. Two coiled tubes are used, one for oil and one for water. These tubes can be formed into a single twin tube unit where the two tubes are joined together for ease of handling. Another method is to use two single tubes fed simultaneously, using two tubing rigs at the surface. Other arrangements are possible, depending on the circumstances. For example, if conventional jointed tubing is available, the oil could be transported to the surface through the conventional tubing and the water through the space between the tubing and the casing.

If a water disposal zone is established downhole by casing perforations located above or below the production perforations, the separator can be positioned so that the disposal packer bridges the disposal zone. The bottom packer is designed to create an isolated region for fluid disposal by sealing to the casing near the top and the bottom of the packer. The output of the water discharge control valve would terminate in this fluid disposal zone. In this way, the water separated would be re-injected back into the disposal formation. Depending on where the disposal zone is located, the pump would be located below or above the bottom packer and a pump standoff tube would be used to position the pump at the proper location below or above the separator. The same arrangement can be created using two packers, but a lower packer with a fluid disposal zone is more efficient.

In the case where the disposal zone is located below the production zone, a simpler arrangement of pump/packers/separator can be used. In this case, the pump would be located near the production perforations, with the separator located directly below the pump. The pump would discharge into the center of the separator, through a discharge tube extending downward from the pump. The water discharge zone would be located either at the bottom of the separator or below the separator. Oil would be directed upward, toward the surface. To pass the pump, a flexible tubing, such as coiled tubing would be used. A simple water valve can be located at the bottom packer, and discharge into the area below the disposal packer into the bottom of the well, where the disposal zone is located.

DESCRIPTION OF THE SEVERAL VIEWS OF THE DRAWINGS

Referring to FIG. 1, The submersible pump, 1 is located inside the casing 12, in the vicinity of the production perforations 2. The perforations allow formation fluid 3 to flow from the formation into the area inside the casing, 12. The submersible pump takes the fluid from inside casing 12, and below packer 7 and pressurizes it to a level sufficient to lift the fluid to the surface, and discharges it through standpipe 4. From standpipe 4, the fluid flows into a region near the center of the separator, which is defined by lower packer 7 and upper packer 15 and the casing 12. The packers seal tightly to the casing, 12 to form a pressure tight seal. The upper packer, 15, the lower packer 7 and the casing 12, define the separator volume and are a leak tight fluid container. As more fluid is added to the separator through standpipe 4, it displaces fluid already in the separator, and forces fluid from the separator into oil inlet pipe 14, and water inlet pipe 9. The oil inlet pipe, 14, originates in an area toward the top of the separator 16, where the oil tends to accumulate after it separates. The water inlet pipe 9 originates in an area toward the bottom of the separator, 6, where water tends to accumulate after it separates.

Figure 1:
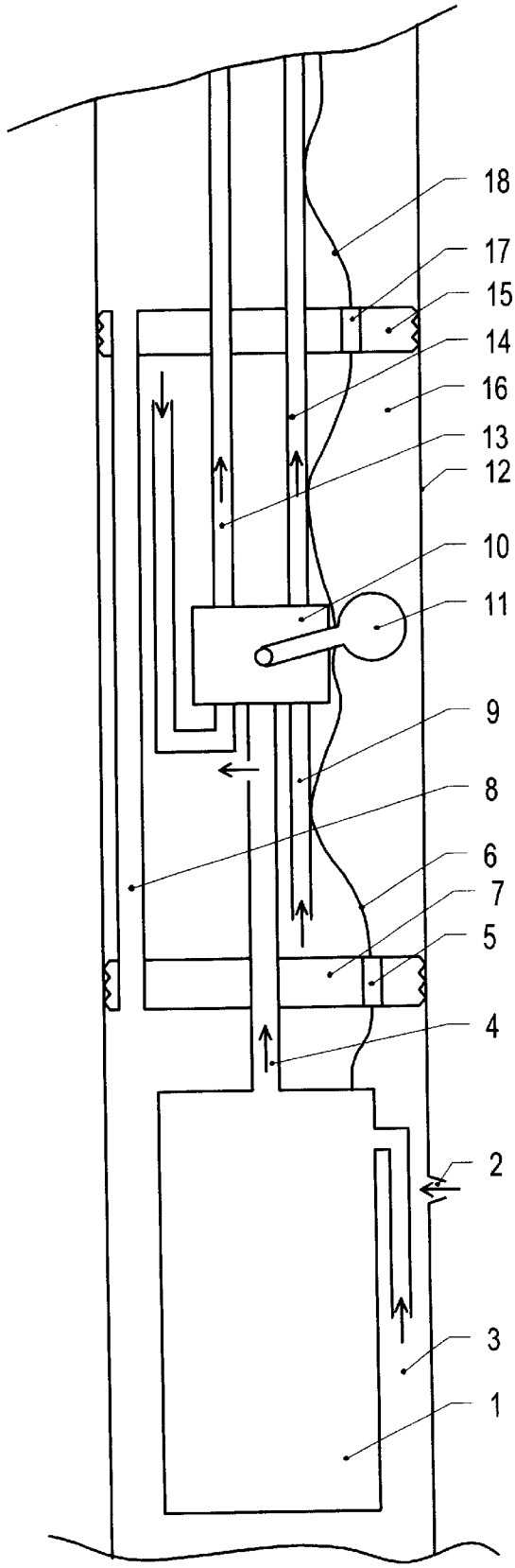
FIG. 1 is a schematic representation of a downhole gravity separator as it would be deployed in a well where the separator is located above the pump and production perforations, and both the oil and water are conveyed to a point above the separator.

Both the oil inlet pipe, 14 and the water inlet pipe 9 terminate at the control valve 10. The control valve 10 separately regulates the relative amounts of oil and water that flow through the oil inlet pipe 14, and the water inlet pipe 9 to the oil outlet pipe 13 and the water inlet pipe 14 respectively. The control valve 10 is controlled by the position of the float 11, which is of a density that is greater than oil and less than water so it floats on the interface between the two. The control valve 10 discharges into oil outlet pipe 13 and water outlet pipe 14, which are connected to and pass through upper packer 15 and are connected to the surface or other apparatus farther up the casing. Electrical power for the submersible pump originates from the surface, and is provided to the submersible pump flexible electric 1 through cable 18, which passes through upper packer 15 and lower packer 7, using two pressure tight electrical penetrators 5 and 17.

Figure 2:
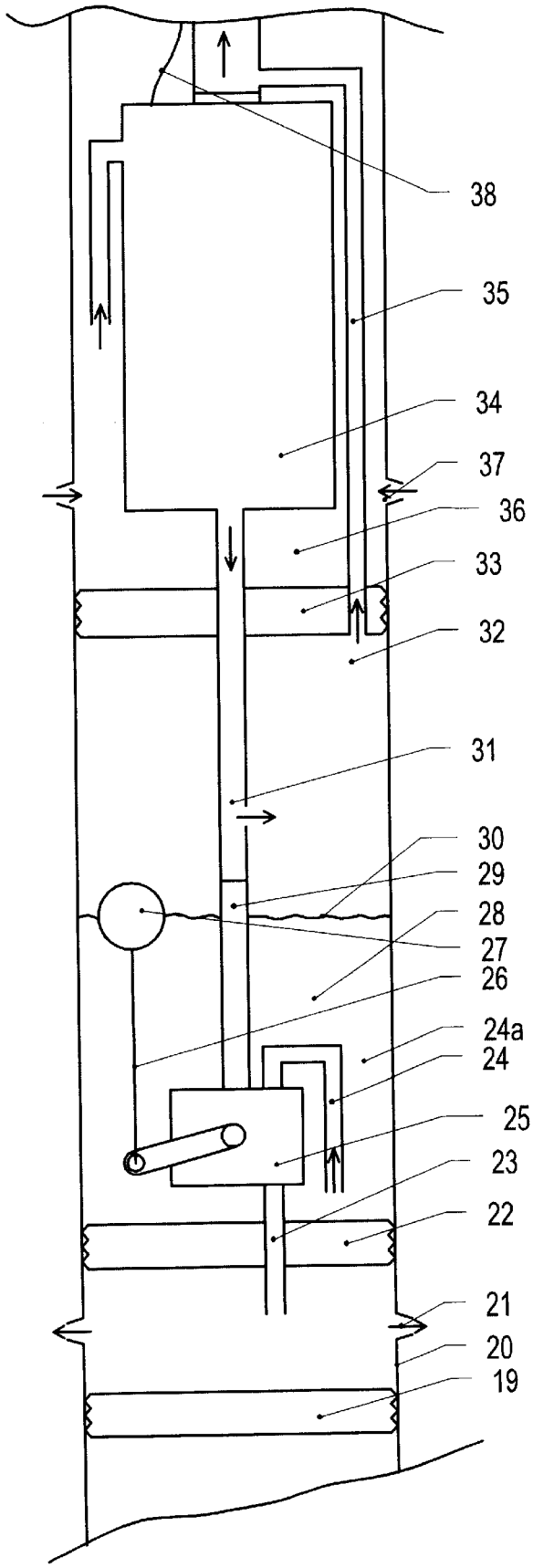
FIG. 2 is a schematic representation of a downhole gravity separator as it would be deployed in a well where the separator is located below the pump and production perforations and the oil is conveyed to a point above the pump, and the water is discharged into a disposal zone below the separator.

Referring to FIG. 2, The submersible pump, 34 is located inside the casing 20, in the vicinity of the production perforations 37. The perforations allow formation fluid to flow from the formation into the area inside the casing, 20. The submersible pump takes the fluid from inside casing 20, and above upper packer 33 and pressurizes it to a level sufficient to lift the fluid to the surface, and discharges it through standpipe 31. From standpipe 31, the fluid flows into a region near the center of the separator, which is defined by lower packer 22 and upper packer 33 and the casing 20. The packers 22 and 33 seal tightly to the casing, 20 to form a pressure tight seal. The upper packer, 33, the lower packer 22 and the casing 20, define the separator volume and are a leak tight fluid container. As more fluid is added to the separator through standpipe 31, it displaces fluid already in the separator, and forces fluid from the separator into oil inlet pipe 35 which passes through upper packer 33 and is routed around submersible pump 34 and is connected to the surface. Similarly, as more fluid is added to the separator through standpipe 31 it displaces fluid already in the separator, and forces fluid from the separator into water inlet pipe 24 which is connected to control valve 25. The oil inlet pipe, 35, originates in an area toward the top of the separator 32, where the oil tends to accumulate after it separates. The water inlet pipe 24 originates in an area toward the bottom of the separator, 24*a*, where water tends to accumulate after it separates.

The water inlet pipe 24 terminates at the control valve 25. The control valve 25 regulates the amount water that flows through the water inlet pipe 24, thereby also controlling the amount of oil exiting the separator through oil outlet pipe 35, when the pressure required to force fluid out the oil outlet pipe 35 is greater than that required to force fluid out the water inlet pipe 35. The control valve 25 is controlled by the position of the float 27, which is of a density that is greater than oil and less than water so it floats on the interface between the two. The control valve 25 discharges into the water outlet pipe 23, that is connected to and passes through lower packer 22 in discharges into the volume below the separator. Electrical power for the submersible pump originates from the surface, and is provided to the submersible pump 34 through cable 38. Below the separator is perforations 21 in the casing 20, that allow water from the separator to be disposed downhole into the geological formation. Optional disposal packer 19 may be used to prevent discharge into zones below the disposal zone.

Figure 3:
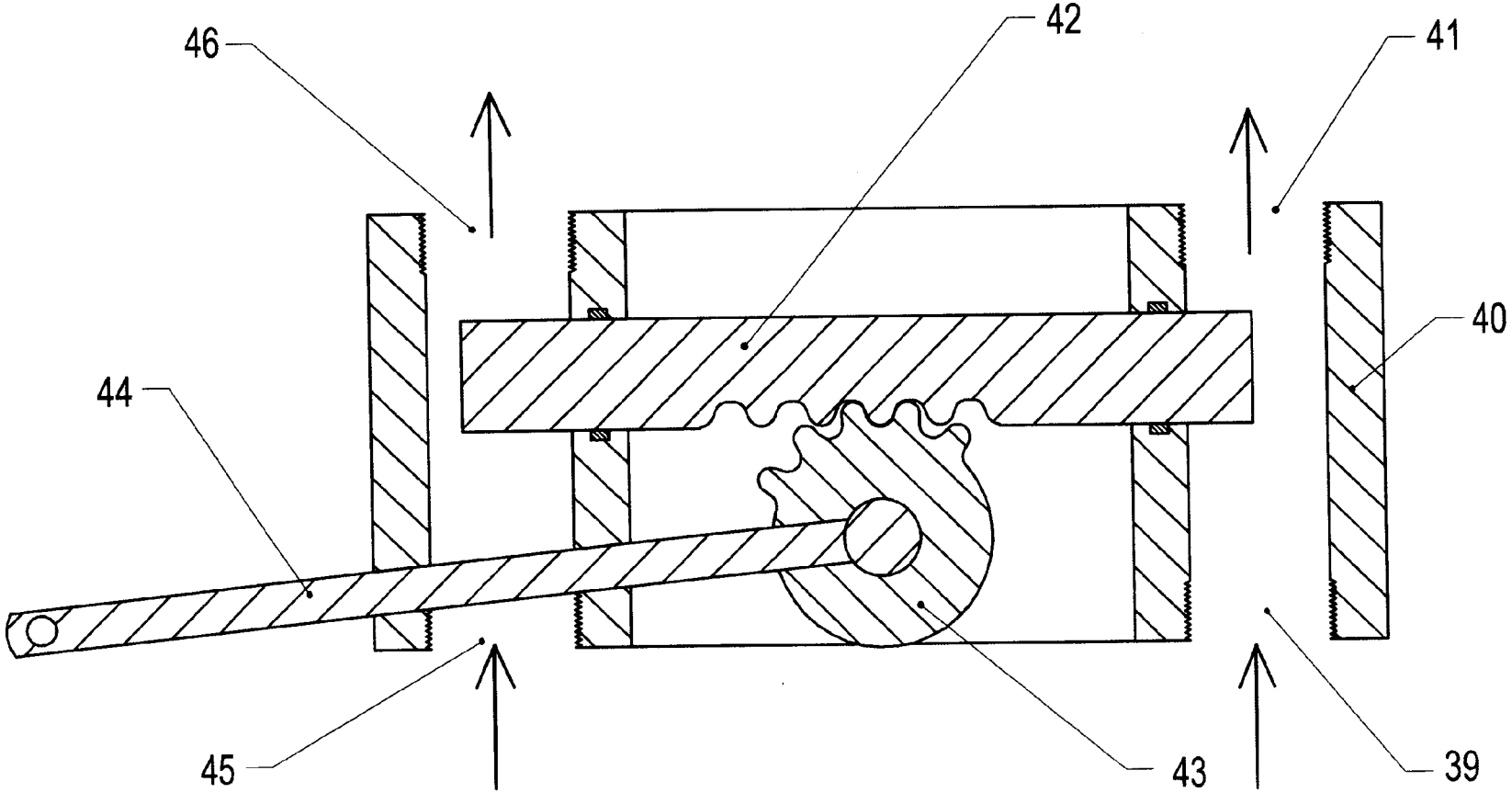
FIG. 3 is a cross sectional view of the control valve showing the fluid passages and control mechanism.

Referring to FIG. 3, control valve housing 40 consists of a suitable material such as steel or aluminum and has drilled into it passages that connect oil inlet 39 to oil outlet 40 and water inlet 45 to water outlet 46. Flow through these passages is constricted by plunger 42 that moves along an axis perpendicular to the passages. The plunger 42 is typically a cylindrical form, with ends that conform to the shape of the passages such that the flow through the passages is completely blocked when the plunger is at the extremes of the plunger travel. The plunger 42 is driven by cam 43 that is connected to arm 44 that moves in an arc under the influence of a float (not shown). Cam 43 is connected to plunger 42 by gearform teeth and is suspended on suitable bearings that only allow rotation in a plane perpendicular to the movement of the plunger 42. Plunger 42 is sealed from the passages by o-ring type seals.

Figure 4:
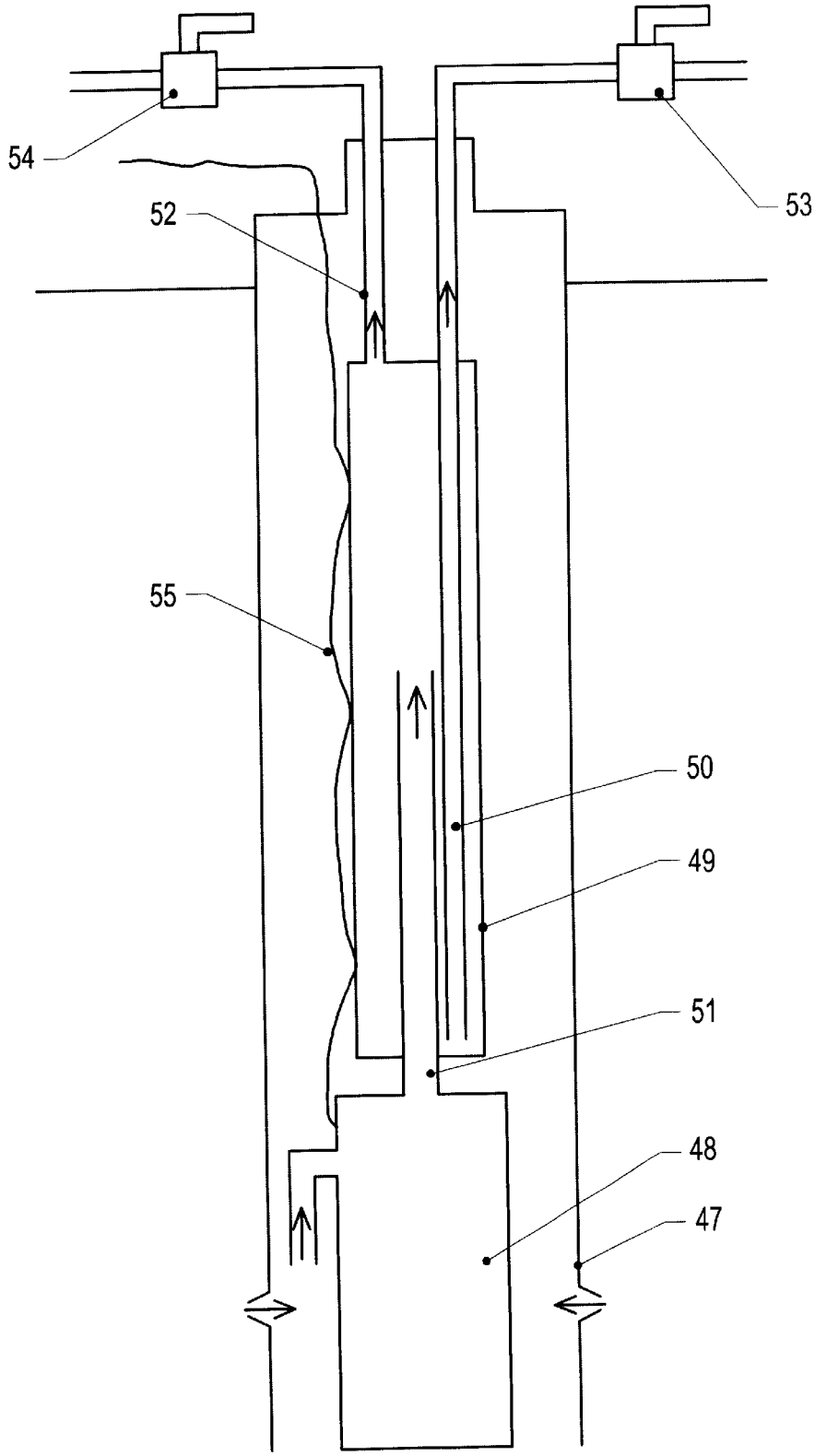
FIG. 4 is a schematic representation of a downhole gravity separator as it would be deployed in a well where the separator is locate above the pump, and the separated oil and separated water is conveyed to the surface.

Referring to FIG. 4, a pressure tight container, 49 is located inside well casing 47. The pressure tight container, 49 is capable of withstanding the output pressure of submersible pump, 48, which is connected to the pressure tight container 49, via standpipe 51. Power is supplied from the surface through flexible electric cable 55. Well fluid is injected by the submersible pump 48, through standpipe 51, into the pressure tight container 49. Once in the pressure tight container, 49, the well fluid separates by gravity into lighter, oil and gas component that is transported to the surface through oil pipe 52, and similarly, the heavier water component is conducted to the surface via water pipe 50. Oil control valve 54 is attached to the termination of oil pipe 52, and regulates the flow of oil and gas from the separator. Water control valve 53 is attached to the termination of water pipe 50, and regulates the flow of water from the separator.

DETAILED DESCRIPTION OF THE INVENTION

The preferred embodiment of this invention uses a submersible pump of the type described in the '198 patent. The pump is powered by a three phase electric motor that is connected to an electric cable that is connected to the surface. Other pumps could also be used such as a submersible piston pump, submersible progressing cavity pump or submersible centrifugal pump. The pump is powered by a three phase electric motor in the preferred embodiment, but other types of motors such as DC brushless motor can offer the additional advantage of speed control to regulate the total output of the pump.

The pump inlet is located in the well's production zone. In the preferred embodiment, the pump inlet is located below the production perforations, but any arrangement that allows unseparated well fluid to flow from the production perforations to the pump inlet will work. If the water disposal zone is located above the production zone, or if the water is produced to the surface, the separator is located directly above the submersible pump and directly connected to it through a discharge tube. If the water disposal zone is located below the production zone, the separator is located directly below the submersible pump and directly connected to it through a discharge tube. The preferred embodiment of the separator is to use two downhole packers to isolate a section of casing directly below the pump. These packers are separated in the well vertically a distance that allows for an average dwell time greater than 10 minutes. For typical oil wells, this distance is about 30 to 100 feet. The preferred packer is Model ETI-1x manufactured by Elder Tools. This packer forms a pressure tight seal when differential pressure is applied across the packer and releases when upward force is applied to the center of the packer. This allows for ease of removal and automatic sealing in use.

Passing through the packers are pressure tight connections for fluid tubes, allowing the various fluid streams to pass through the packers. In the preferred embodiment, these are in the form of pipe threaded holes for connection to coiled tubing. An electrical penetrator is used to pass three phase electrical power through the top of the separator if needed. The bottom packer used to form the bottom of the separator is the same as the top, but may have fewer penetrations. Similar to the top of the separator, the bottom also uses the same electrical penetrator to pass three phase power from the separator to the pump.

An alternate arrangement replaces the packers with solid plates made of steel and a cylindrical steel section welded to the cylindrical ends to form a pressure tight container that fits inside the well casing. The steel should be thick enough to withstand the output pressure of the pump. The connections and penetrations are the same as the preferred embodiment. The length of this section cannot exceed the capabilities of the pulling rig used to install the unit (typically 30 feet), but may be jointed to achieve more length.

Another alternative arrangement is to modify the lower packer to create an isolated zone between the top and bottom of the lower packer by sealing to the casing near the top and near the bottom of the packer. This zone would be positioned to bridge a perforated area of the casing that forms the fluid disposal zone. The output of the water control valve would be connected to this zone, allowing for convenient disposal of water. Alternatively, the output of the water control valve could be connected to the surface, the bottom of the well or any other disposal zone located in the well. If the disposal zone is located at the bottom of the well, the water can be discharged below the bottom packer.

The output of the submersible pump is connected to the separator with a pressure tight pipe to locate the pump in the proper position. Attached to this connection is a tube that conducts the output of the submersible pump to the vertical center of the separator or to a level at least 10 feet above or below the bottom or top of the packers. Attached to this tube is a center structure that contains the discharge control valves. This pipe also proves part of the mechanical structure that connects the bottom of the separator the center structure.

The discharge control valve regulates the relative amount of flow into the oil and water output tubes. The preferred method for regulating the flow is to use a float that is of the proper density to float on water, yet sink in oil. This float is connected to a control valve that allows equal flow through the valve into the oil and water output tubes when the float is at the vertical center of the separator. When the float falls, the oil side of the valve allows increased flow into the oil output tube, and the water side of the valve decreases the flow into the water output tube. When the float rises, the opposite occurs. This regulates the relative flow of oil and water to maintain the oil water interface in the center of the separator. This type of valve is typically a mechanical plug type, where the plug moves to restrict the flow depending on the position of the plug. The valve is typically spring loaded and connected to the float, either magnetically or mechanically. When the float moves, the valve moves the appropriate direction to increase or reduce flow.

The discharge control valve outputs are connected to the oil and water output tubes. These tubes connect the valve located at the center of the separator to the top of the separator. In the preferred embodiment, these tubes also serve as a mechanical structure to connect the top of the separator to the center structure. Also attached to the control valve inputs are tubes that terminate near the top of the separator for the oil side of the valve and near the bottom of the separator for the water side of the valve.

In the case where the disposal zone is located downhole, and the water discharge pressure is always lower than the oil discharge pressure, a simpler discharge control valve can be used that is the same as the discharge control valve described except it lacks an oil section. The oil portion of the separator would then be directly connected to the oil discharge pipe.

In the preferred embodiment, the water is disposed in a water disposal zone that is created below the bottom packer of the separator by perforating the casing below the separator, creating disposal perforations into a geologic zone capable of receiving the water discharge from the separator. The output of the water discharge pipe discharges into this zone located below the bottom packer, and flows under pressure through the disposal perforations into the surrounding geological formation. If desired, another packer can be placed below the disposal perforations to prevent flow through the bottom of the well.

What is claimed is:

1. A downhole gravity oil and water separation system comprising:

a. a casing having one or more production perforations, said casing extending from a ground surface downwardly such that said production perforations communicate with a production zone so that produced liquid hydrocarbons and produced water enter said casing through said production perforations;

b. a low-volume submersible pump disposed in said casing;

c. a pump inlet means for permitting the produced liquid hydrocarbons and produced water to enter said pump;

d. a pump outlet means for permitting the produced liquid hydrocarbons and produced water to exit the pump;

e. a gravity oil and water separator defined by the casing, an upper downhole packer and a lower downhole packer, said downhole packer sealing tightly to the casing to form a pressure tight seal, said separator enclosing a mixture of oil and water in a variable volume defined by the position of the packers;

f. a flexible electrical cable frictionally engaged to the pump and extending between said pump and the ground surface, said cable providing electric power to said pump and being sufficiently thin and flexible to pass through the separator if necessary without interfering with the operation of said separator;

g. a single standpipe conduit extending between the separator and the pump outlet means, said standpipe conduit discharging near the center of the separator and allowing the separator to be pressurized to the output pressure of the pump;

h. an oil discharge means connecting the oil side of the separator to the ground surface, said discharge means terminating near the top of the separator;

i. a control valve system capable of regulating the flow of oil and water from the separator; and j. a water discharge means connecting the water side of the separator to a water disposal system, said water discharge means terminating near the bottom of the separator.

2. A downhole gravity oil and water separation system according to claim 1 wherein the separator is located directly above the pump and pressure-tight electrical penetrator means are used to pass electrical power from the electrical cable to the separator and from inside the separator to the low-volume submersible pump located below the separator.

3. A downhole gravity oil and water separation system according to claim 2 wherein the water discharge means connects the water side of the separator to a disposal zone located above the production zone, said disposal zone being separated from t he production zone by at least one disposal packer, said disposal zone being created by allowing fluid to exit the casing through at least one casing perforation located between the lower packer and the disposal packer.

4. A downhole gravity oil and water separation system according to claim 1 wherein the separator is located directly below the pump.

5. A downhole gravity oil and water separation system according to claim 4 wherein the water discharge means connects the water side of the separator to the disposal zone located below the production zone, said disposal zone being separated from the production zone by the disposal packer, said disposal zone being created by allowing fluid to exit the casing through the casing perforation.

6. A downhole gravity oil and water separation system according to claim 4 wherein the water discharge means connects the water side of the separator to the disposal zone located below the production zone, said disposal zone being separated from the production zone by the disposal packer, said disposal zone being defined by the bottom of the well below the casing.

7. A downhole gravity oil and water separation system according to claim 1 wherein the separator is defined by a pressure-tight chamber sufficiently resistant to withstand the outlet pressure of the pump, said chamber enclosing a fixed volume of an oil and water mixture and being bounded by the upper downhole packer, the lower downhole packer and the casing.

8. A downhole gravity oil and water separation system according to claim 1 wherein the water disposal system is located on the ground surface.

9. A downhole gravity oil and water separation system according to claim 1 wherein the separator is defined by an enclosed, pressure tight volume created by a separate container.

10. A downhole gravity oil and water separation system according to claim 1 wherein the low-volume submersible pump is a positive displacement pump.

11. A downhole gravity oil and water separation system according to claim 1 wherein the low-volume submersible pump is a centrifugal pump.

12. A downhole gravity oil and water separation system according to claim 1 wherein the lower packer and the disposal packer bridge across the disposal zone so that a sealed separator volume is defined by the lower packer and the upper packer, and a water injection zone is defined by the lower packer and the disposal packer.

13. A downhole gravity oil and water separation system according to claim 1 wherein at least one additional downhole packer is used to separate the production zone located near the pump inlet from the disposal zone.

14. A downhole gravity oil and water separation system according to claim 1 wherein the control valve system comprises a single valve located inside the separator so that both hydrocarbon liquid and water discharge through said valve.

15. A downhole gravity oil and water separation system according to claim 1 wherein the control valve system comprises a single valve located near the bottom of the separator so that said valve regulates the flow of water out of the separator into the disposal zone and the hydrocarbon liquid is discharged near the top of the separator into the oil discharge means.

16. A downhole gravity oil and water separation system according to claim 1 wherein the control valve comprises a first valve controlling the discharge of oil and gas from the separator, said first valve having an input connected to a conduit terminating near the top of the separator and an output connecting the separator to the surface, a second valve controlling the discharge of water from the separator, said second valve having an input connected to a conduit that terminates near the bottom of the separator and an output connected to a conduit connecting the separator to the surface.

17. A downhole gravity oil and water separation system according to claim 1 wherein a single control valve is used to regulate the discharge of oil and gas from the separator, said valve being located near the top of the separator.

* * * * *